United States Patent [19]

Burke

[11] 4,063,378

[45] Dec. 20, 1977

[54] PICTURE FRAME

[76] Inventor: Louis C. Burke, 242 Hartford Ave., East Granby, Conn. 06026

[21] Appl. No.: 733,037

[22] Filed: Oct. 18, 1976

[51] Int. Cl.[2] ..... G09F 1/12

[52] U.S. Cl. ..... 40/156

[58] Field of Search ..... 40/156, 152; 40/10, 40/156

[56] References Cited

U.S. PATENT DOCUMENTS

| | | | |
|---|---|---|---|
| 1,462,419 | 7/1923 | Mandel | 40/156 |
| 3,255,544 | 6/1966 | Bornholt | 40/156 |

FOREIGN PATENT DOCUMENTS

| | | | |
|---|---|---|---|
| 112,937 | 4/1929 | Austria | 40/156 |

*Primary Examiner*—Louis G. Mancene

*Assistant Examiner*—Wenceslao J. Contreras

[57] ABSTRACT

An assembly for displaying panels, for example, a picture frame, comprises a frame member having a display opening therein. The frame member has a front face, which is the face facing a viewer looking at the panel or picture displayed in the frame member, and an opposite rear face. A rearwardly facing peripheral shoulder is formed about the perimeter of the display opening so that the size of the display opening in the rear face is larger than its size in the front face. A flexible back closure member is affixed by tongue and groove locking formations across the rear of said display opening to maintain panels (e.g., a glass panel, a picture, and a backing board) within said display opening with the peripheral portions thereof seated against the peripheral shoulder.

10 Claims, 10 Drawing Figures

PICTURE FRAME

BACKGROUND OF THE INVENTION

The present invention concerns an assembly for displaying panels, the most common form of which is a picture frame. However the invention is not limited thereto since the assembly may display any panel or panel shaped object including a mirror, three dimensional objects mounted on panels, etc.

A large number of frame assemblies are known and disclosed in prior patents providing ample testimony of intensive efforts by the art over the years to provide efficient, economical, and attractive assemblies for mounting and displaying panel like articles. Much of this effort has been directed towards providing various means to assemble the panels for retention within the frame more expeditiously than was possible by the conventional means of driving a plurality of small nails into the rear side of the display opening of the frame to retain the panels, backing board etc. in place.

For example, U.S. Pat. No. 3,711,978 shows a frame preferably of molded synthetic plastic material having an inwardly sloping projection along its peripheral walls which retained sufficient flexibility to permit the projection to be deformed sufficiently to receive therein a peripheral edge portion of the backing board. U.S. Pat. No. 1,904,318 shows a somewhat similar concept in which a frame has formed on the rear side thereof elastic flaps beneath which the backing board is inserted to retain it against the rear of the frame.

U.S. Pat. No. 2,312,007 shows a frame having a groove formed in the rear thereof which serves as a pocket for adhesive to secure the backing seat to the rear of the frame.

U.S. Pat. No. 3,060,606 shows a slotted frame of resilient material whose opposed legs are forced apart to receive therein the glass, picture, and backing panels.

U.S. Pat. No. 3,070,914 shows a plastic picture frame having clip receiving panels molded on the rear side thereof into which retaining clips may be force-fitted, the clips serving to retain the backing board in place.

U.S. Pat. No. 3,546,802 uses a force-fit concept in which what is in effect a thick backing board is provided as part of the frame assembly and the decorative frame is sized to be force-fitted over the backing board to retain the panels between the force-fitted frame and the backing board.

Finally, U.S. Pat. No. 3,736,684 shows a frame member having a peripheral groove within which the edges of the panels are wedged.

The foregoing patents are typical of many different patented prior art schemes.

Some of these prior art schemes have one or more shortcomings. Some require that the frame or portions thereof be sufficiently elastically deformable to receive and hold the backing board. This limits the materials from which the frame can be made with corresponding limitations on the appearance and quality of the frame. Other of the prior art structures necessitate a forcing or wedging of the panels into the frame which may have a tendancy to mar the peripheral edge portions of the panels. Other of the prior art structures are more or less complex thereby increasing their manufacturing cost.

It is accordingly an object of the present invention to provide a novel assembly for displaying panels which is simple, permits a virtually unlimited selection of material from which the frame member may be made and which maintains the panels within the display opening of the assembly without necessity of forcing or otherwise stressing the edges of the panels being displayed.

It is another object of the present invention to provide an assembly, one including a frame member which has a display opening therein, the display opening being larger in the rear of the frame member than it is in the front of the frame member to permit placing of panels within the display opening and which includes closure members affixable across the rear of the display opening to maintain the display panels therein.

It is yet another object of the present invention to provide an assembly for displaying panels which assembly includes a frame member having a display opening therein and closure means affixable transversely across the display opening at the rear of the frame to maintain the display panels therein.

Other objects and advantages of the present invention will become apparent from the following description.

SUMMARY OF THE INVENTION

An assembly for displaying panels (such as pictures, mirrors, etc.) has a frame member which has an outer periphery, a front face and an oppositely facing rear face. A display opening extends axially through the frame member and the perimeter of the display opening defines the inner periphery of the frame member. A retaining shoulder is formed about the perimeter of the display opening and is adapted to have a peripheral portion of one of the panels seated thereon. The retaining shoulder is defined by a rearwardly facing ledge which is disposed intermediate the front face and the rear face and a side wall extending from the ledge towards the rear face and terminating therein so that the display opening is larger in the rear face than it is in the front face. A first locking formation comprises one of either a tongue or a groove and is disposed about the perimeter of the display opening axially rearwardly of the ledge of the frame member to define between the ledge and the first locking formation a mounting space to receive the panels. A closure member, at least portions of which are flexible, and which has edges is part of the assembly. A second locking formation, which is complementary to the first locking formation, comprises the other of the tongue and groove. The second locking formation is located on the back closure member adjacent to at least two opposite edges thereof. The first and second locking formations are engageable with each other by flexing the closure member to engage its second locking formation with respective portions of the first locking formation whereby the closure member is locked onto the frame transversely across at least a portion of the rear face of the display opening and in contact with the rearmost one of the panels to retain the panels seated against the ledge of the retaining shoulder.

Other objects of the invention are attained when the closure member in its free state is of bowed construction and is deformed against the panels to bias the panels against the ledge of the retaining shoulder.

Other objectives are attained by providing the first locking means in the form of a tongue and the second locking means in the form of a groove. This order may be reversed, and the first locking means may be provided in the form of a groove and the second locking means in the form of a tongue.

Other objectives of the invention are attained by providing the closure means of a size to extend substantially over and cover the rear face display opening.

DESCRIPTION OF THE PREFERRED EMBODIMENTS

Figure 1:
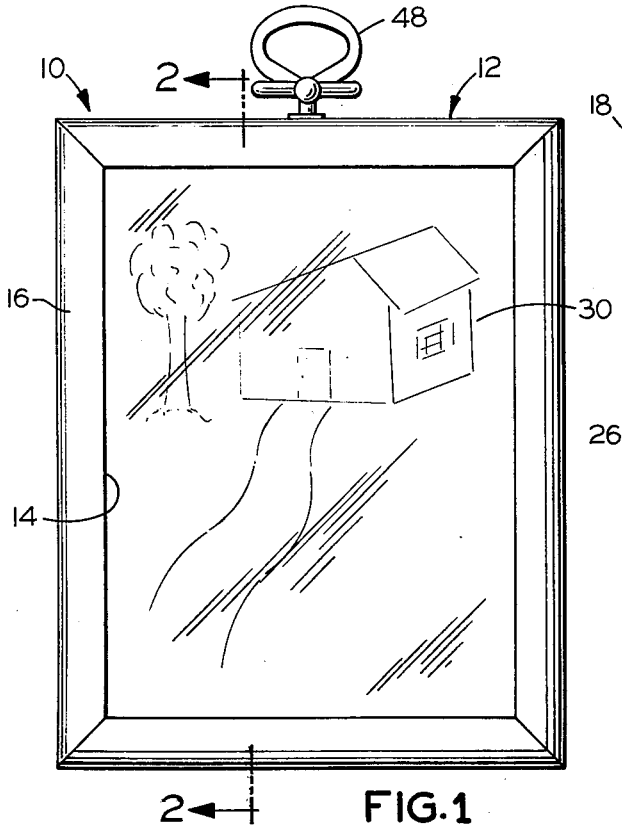
FIG. 1 is a front view of one embodiment of a frame assembly in accordance with the invention containing as display panels a plate of glass, a picture, and a backing board.

Referring to FIG. 1, an assembly comprising one embodiment of the present invention is generally indicated at 10 and includes a frame member 12 which has a display opening 14 formed therein.

Figure 3:
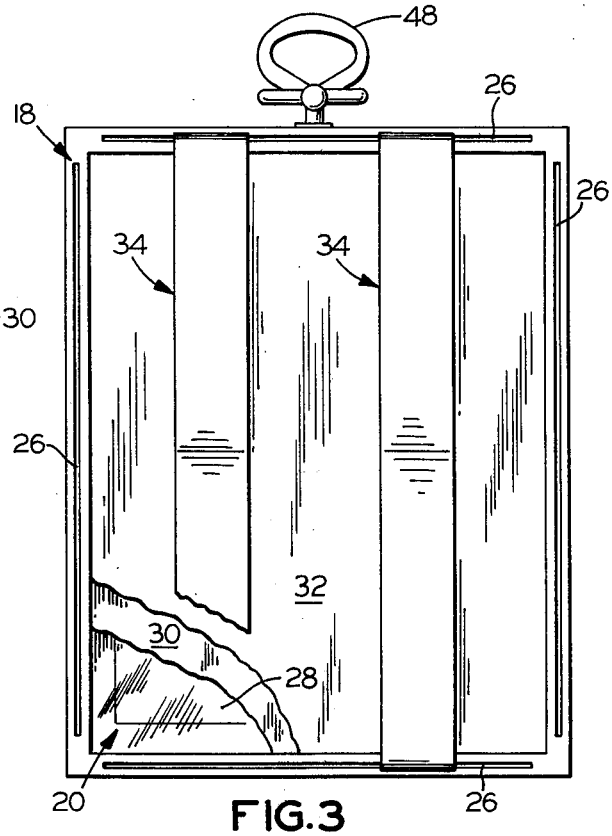
FIG. 3 is a rear view of the embodiment of FIG. 2, with portions broken away for clarity of illustration.
Figure 2:
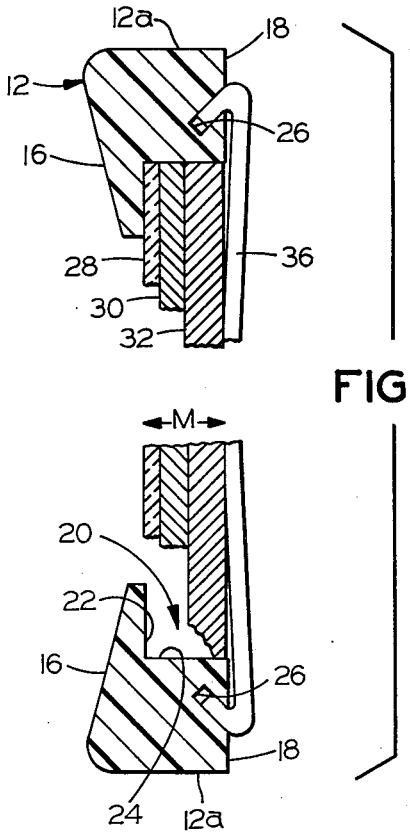
FIG. 2 is a partial section view along section line 2—2 of FIG. 1, with the scale enlarged relative to the scale of FIG. 1.

Referring to FIGS. 1, 2, and 3, display opening 14 is seen to extend from front face 16 (FIG. 2) of frame member 12 axially therethrough to rear face 18, and to be transversely bounded by inner periphery of frame 12.

Referring to FIGS. 2 and 3, a retaining shoulder 20 is formed about the perimeter of display opening 14 and is defined by a rearwardly facing ledge 22 and a side wall 24. Side wall 24 extends towards and terminates in rear face 18 so that, as best seen in FIGS. 2 and 3, the rear face opening of display opening 14 is larger than its front face opening.

Still referring particularly to FIGS. 2 and 3, grooves 26 are seen to be disposed about the perimeter of display opening 14. In the embodiment shown, grooves 26 collectively comprise a first locking formation. A number of panels are retained and displayed within assembly 10. In the embodiment shown, these comprise a pane of glass 28, a picture 30, and a backing board 32. These three panels are assembled in surface to surface contact in a mounting space disposed between ledge 22 and grooves 26. This axial space is generally indicated in FIG. 2 by the dimension arrow M.

Figure 4:
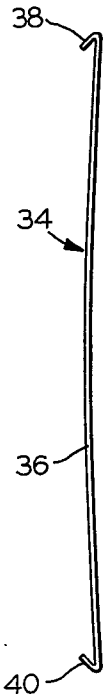
FIG. 4 is a side view of one of the closure members illustrated in FIG. 3.
Figure 4A:
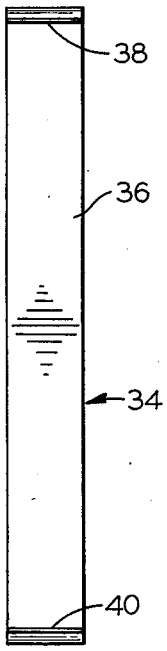
FIG. 4A is a plan view of the closure member of FIG. 4.

Referring to FIGS. 2, 3, 4, and 4A, a pair of closure members are generally indicated at 34 and have a main body portion 36 and lips 38, 40. Lips 38, 40 are seen to be disposed adjacent opposite edge portions of closure members 34. As best seen in FIG. 4, main body portion 36 of closure members 34 are bowed in their free or unassembled state.

To assemble the assembly illustrated, empty frame member 12 has placed therein, through the rear face portion of display opening 14, pane 28 so that peripheral edge portions of pane 28 are seated against ledge 22. Picture 30 and thereafter backing board 32 are inserted in the identical manner. Backing board 32 serves to more or less fill out mounting space M and to provide strength and support for glass 28 and picture 30. Closure means 34, which are of flexible bowed construction as indicated above, are then taken and one of lips 38 or 40 is inserted into groove 26 at a suitable location therealong. Main body portion 36 of closure member 34 is then flattened somewhat and the uninserted one of lip 38, 40 is inserted into the portion of groove 26 opposite the portion into which the other lip was inserted. This procedure is repeated for additional closure members as required. The result is, as seen in FIG. 2, that closure members 34 are held in place and their resilient tendancy to assume a free state bowed condition exerts a biasing pressure against backing board 32 which urges the plurality of panels forwardly to seat peripheral edges of pane 28 against ledge 22 of retaining shoulder 20. This maintains the various panels in secure and tight surface to surface contact. It will be apparent from the drawings and foregoing description that the closure members are removably mounted and may be readily removed and replaced for further disassembly and assembly as desired.

As best seen in FIG. 2, it will be noted that grooves 26 have an opening in rear face 18 and the groove side walls (unnumbered) are inclined from the outer periphery (12*a* in FIG. 2) of frame member 12 towards the inner periphery thereof. This inclined construction of grooves 26 helps to seat closure members 34, by virtue of the engagement of lips 38, 40 thereof with grooves 26, firmly in place.

Figure 5:
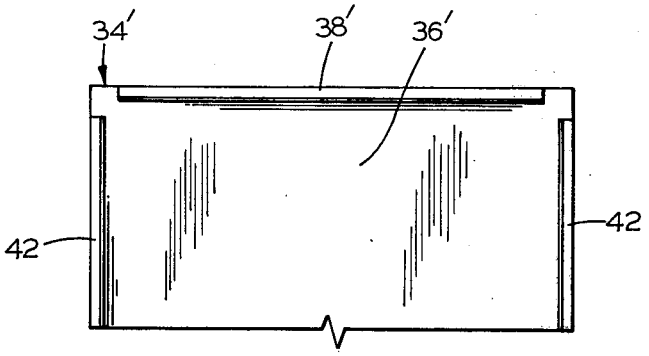
FIG. 5 is a partial plan view of another embodiment of a closure member.

Obviously, closure means 34 may be of any desired width dimension (left to right as viewed in FIG. 3) broad or narrow as desired or required. This includes an embodiment such as shown in FIG. 5 wherein closure member 34' has lips 38' and, in addition, side lips 42. Closure member 34' may be fitted over frame member 12 of FIG. 3 so as to entirely cover and enclose the rear face portion of display opening 14.

Closure members 34, 34', although preferably bowed somewhat to provide the biasing action, need not necessarily be bowed. For example, with respect to the FIG. 5 embodiment, main body portion 36' of closure member 34' may be made of a somewhat thicker unflexible material so that it serves substantially as a backing board. Lip portions 38', 42 may be made flexible to facilitate insertion into grooves 26.

Figure 6:
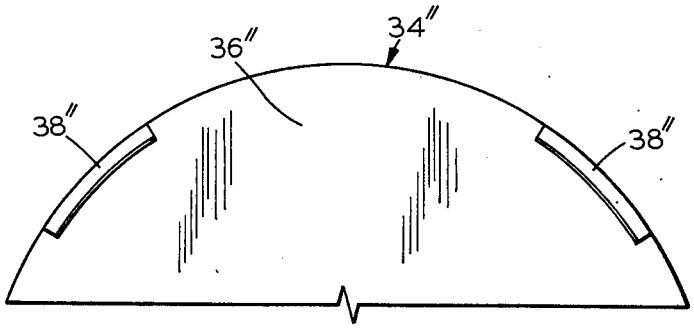
FIG. 6 is a partial plan view of yet another embodiment of a closure member.

In FIG. 6, there is shown in partial view another embodiment of the closure means, in this case comprising a closure means 34'' whose main body portion 36'' is oval in shape. Lips 38'' are provided in relatively short segments to facilitate insertion into a groove or plurality of grooves arranged in an oval pattern. FIG. 6 illustrates a full covering backing board type oval closure means. Obviously, the strip type closure means illustrated in FIG. 3 could also be employed on an oval or circular or other nonrectilinear shaped frame. Further, if desired, closure means such as closure means 34 in FIG. 3 could be applied horizontally (as viewed in FIG. 3) across the rear face portion of the display opening.

Figure 2A:
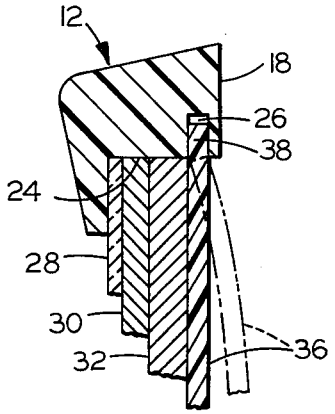
FIG. 2A is a view corresponding to the upper portion of FIG. 2 showing another embodiment of the invention.

FIG. 2A, a view corresponding to the upper portion of FIG. 2, shows another embodiment of the invention. Parts of the FIG. 2A embodiment which are similar to corresponding parts of the FIG. 2 embodiment are identically numbered. Thus, in this embodiment glass pane 28, picture 30 and backing board 32 are similarly received within display opening 14 and the peripheral edges thereof are seated within retaining shoulder 20. In this embodiment however, groove 26 does not have an opening which terminates in rear face 18 but rather has an opening which terminates in side wall 24. Main body portion 36 of closure 34 has lips 38 which in this case comprise merely a peripheral edge portion of main body portion 36. Main body portion 36 is flexible so that for insertion into grooves 26 it may be bent slightly as indicated by the dotted lines in FIG. 2A for insertion into grooves 26 on diametrically opposite (relative to display opening 14) portions of the rear face portion of display opening 14.

Figure 2C:
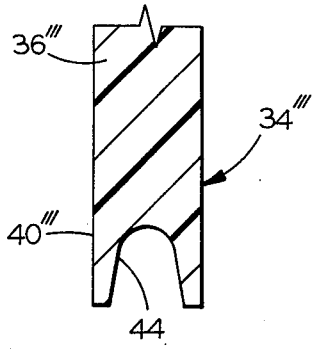
FIG. 2C is a partial view, greatly enlarged with respect to FIG. 2B, of the lip portion of closure means 34''' of FIG. 2B.
Figure 2B:
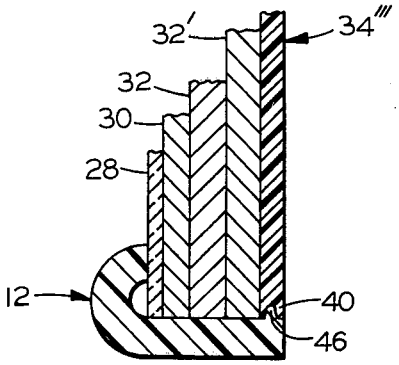
FIG. 2B is a view corresponding to the bottom portion of FIG. 2 showing a third embodiment of the invention.

FIG. 2B shows yet another embodiment of the invention in which corresponding parts are identically numbered to those of FIGS. 1 and 2. In this case, frame member 12 shows a generally J-shaped cross sectional profile. Within shoulder portion 20 there is received a pane of glass 28, a picture 30, and in this case, two backing boards 32 and 32'. Obviously, a single backing board of thicker construction could be employed in lieu of the two backing boards. As best seen in FIG. 2C, main body portion 36''' of closure means 34''' has a lip portion 40''' which comprises a peripheral edge portion of main body portion 36'''. In this embodiment, a peripheral V-shaped groove 44 is provided about at least two opposite edges of closure means 34'''. V-shaped groove 44 is complimentary to a corresponding V-shaped tongue 46 disposed adjacent and about rear face portion of display opening 14. V-shaped tongue 46 is provided in lieu of the groove 26 of the embodiments of FIGS. 2 and 2A. The FIG. 2B embodiment is preferably of the full covering backing board type of closure means and preferably main body portion 36''' thereof is flexible similarly to that of the FIG. 2A embodiment, to facilitate insertion of groove 44 over tongue 46.

It will be noted that the structure of the invention provides rapid and easy assembly without need for nails, glue, adhesives, and without need for complicated parts and fittings. While the frame of the invention may be made from any suitable material, molded plastic frames are preferred. As illustrated in FIGS. 1 and 3, a hanging loop 48 may be provided atop the frame which serves a decorative as well as a utilitarian function. Obviously, the loop may be omitted and a desired type of hanging fixture may be employed, preferably on rear face 18 of frame 12, so it is not visible when the picture or other display is viewed in the completed frame. Hanging means may also be provided on closure means 34.

While frame member 12 and the closure means 34, 34', 34'', and 34''' may be made of any suitable material, molded synthetic organic polymeric materials, i.e., plastics, are preferred for their economy and ease of manufacture. An assembly in accordance with the invention provides the ability to mount panel members such as pictures, mirrors, etc. within the frame without stressing or marring the panels and nonetheless provides means to securely mount the panels within the frame. The closure means may be flexible in its entirety, in which case, only a slight degree of flexible resiliency is required. On the other hand, a flexible portion such as flexible lips affixed to a rigid, nonflexible main body portion may be used. The degree and extent of flexible resiliency required is only that which will suffice to facilitate rapid and easy affixation of the closure means to the frame by engagement of the first and second locking formations provided, respectively, on frame member and the closure member. The closure members may be of rectilinear shape, eg., rectangular as illustrated in FIG. 5, or curvilinear in shape, eg., as illustrated in FIG. 6. The closure members may be of a size, as illustrated in FIG. 3, in which they cover only a part of the rear face of the display opening or they may be of a size to substantially, completely cover and enclose the rear face of the display opening. Regardless of size or shape, the closure member will bear against the rearmost one of the panels retained within the assembly and the frontmost panel will be urged against the ledge of the retaining shoulder, as illustrated in FIG. 2.

While the invention has been described in detail with reference to certain specific and preferred embodiments thereof, it will be apparent that numerous modifications and alterations to the specific embodiments may be made which modifications and alterations are nonetheless within the spirit and scope of the present invention.

I claim:

1. An assembly for displaying one or more panels comprises:

a. a frame member having an outer periphery, a front face and an oppositely facing rear face;

b. a display opening extending axially through said frame member, the perimeter of said display opening defining the inner periphery of said frame member;

c. a retaining shoulder formed about said perimeter of said display opening and adapted to have seated thereon a peripheral edge portion of the frontmost one of said one or more panels, said retaining shoulder being defined by (1) a rearwardly facing ledge disposed intermediate of said front face and rear face and (2) a side wall extending from said ledge towards said rear face and terminating therein so that said display opening is larger in the rear face portion thereof than it is in the front face portion thereof;

d. a first locking formation comprising one of a tongue and a groove, said first locking formation being disposed about the perimeter of said display opening and axially rearwardly of said ledge to define between said ledge and said first locking formation a mounting space to receive said panels;

e. at least one closure member, a portion at least of which is flexible, having edges and being of bowed resilient construction in the free state, and affixed to said frame member by engagement of said first locking formation with a second locking formation as defined herein below;

f. said second locking formation being complementary to said first locking formation and comprising the other of said tongue and groove, said second locking formation being located on said closure member adjacent at least two opposite ones of said edges thereof; said first and second locking formations being engageable with each other by flexing a portion of said closure member to engage said second locking formation thereof with respective portions of said first locking formation whereby said closure member is locked onto said frame transversely across at least a portion of the rear face portion of said display opening and in contact with and deformed against the rearmost one of said one or more panels to bias said one or more panels against said ledge and thereby retain said panels within said mounting space.

2. The assembly of claim 1 in which said first locking formation comprises a tongue and said second locking formation comprises a groove.

3. The assembly of claim 1 in which said first locking formation comprises a groove and said second locking formation comprises a tongue.

4. The assembly of claim 1 including a plurality of closure members, said members having main body portions which extend transversely across a portion only of said rear face portion of said display opening.

5. The assembly of claim 1 wherein said closure member has a main body portion which substantially, entirely covers and encloses the rear face portion of said display opening.

6. The assembly of claim 5 wherein said closure member is of rectilinear shape and has lips disposed along the periphery thereof.

7. The assembly of claim 5 wherein said closure member is curvilinear in shape and has lips disposed along the periphery thereof.

8. The assembly of claim 1 wherein said first locking formation comprises a groove.

9. The assembly of claim 8 wherein said groove has a opening in said rear face and has side walls which are inclined from the outer periphery of said frame member towards the inner periphery thereof.

10. The assembly of claim 8 wherein said grooves have an opening in said side wall.

* * * * *